US007029357B2

(12) United States Patent
Ikeya et al.

(10) Patent No.: US 7,029,357 B2
(45) Date of Patent: Apr. 18, 2006

(54) DISPLAY PANEL AND METHOD OF PRODUCING THE SAME

(75) Inventors: Tomoyoshi Ikeya, Shizuoka (JP); Atsushi Kobayashi, Shizuoka (JP); Yoshihiro Nakajima, Shizuoka (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 66 days.

(21) Appl. No.: 10/603,934

(22) Filed: Jun. 26, 2003

(65) Prior Publication Data

US 2004/0000872 A1 Jan. 1, 2004

(30) Foreign Application Priority Data

Jun. 28, 2002 (JP) ..... P2002-188940

(51) Int. Cl.
*H01J 9/00* (2006.01)

(52) U.S. Cl. ..... 445/24; 313/493; 313/582

(58) Field of Classification Search ..... 445/23–25, 445/2; 313/582–587, 495–497, 231.31, 493, 313/231.1

See application file for complete search history.

(56) References Cited

U.S. PATENT DOCUMENTS 4,626,741 A * 12/1986 Morimoto et al. ..... 313/497
5,209,688 A * 5/1993 Nishigaki et al. ..... 445/24
5,777,610 A * 7/1998 Sugimoto et al. ..... 345/206
5,876,884 A * 3/1999 Maeda et al. ..... 430/22
5,897,414 A * 4/1999 Bergeron et al. ..... 445/3

* cited by examiner

*Primary Examiner*—Ashok Patel
*Assistant Examiner*—Anthony Canning
(74) *Attorney, Agent, or Firm*—Sughrue Mion, PLLC

(57) ABSTRACT

A first positioning mark is formed at four corners of the outer side of the display area of a front substrate at the same step as the step of forming transparent electrodes. The first positioning marks are made of the same material as the material of transparent conductive films and formed in the same layer as a layer in which the transparent electrodes are formed. A second positioning mark is formed at four corners of the outer side of the display area of a back substrate at the same step as the step of forming partition walls. The second positioning marks are made of the same material as the material of glass layers containing white pigments and formed in the same layer as a layer in which the partition walls are formed. The positioning of the transparent display electrodes as well as the partition walls are directly carried out.

35 Claims, 14 Drawing Sheets

V1—V1 CROSS SECTION

V2—V2 CROSS SECTION

W1—W1 CROSS SECTION

W2—W2 CROSS SECTION

V1—W1 CROSS SECTION

V1—W1 CROSS SECTION

V1—W1 CROSS SECTION

DISPLAY PANEL AND METHOD OF PRODUCING THE SAME

CROSS REFERENCE OF RELATED APPLICATION

This application is based on and claims priority under 35 U.S.C. §119 with respect to Japanese Patent Application No. 2002-188940 filed on Jun. 28, 2002, the entire content of which is incorporated herein by reference.

BACKGROUND OF THE INVENTION

The present invention relates to a display panel such as a plasma display panel and a method of producing the display panel.

A display such as a plasma display panel (hereinafter called the PDP) using glass substrates is formed by putting two sheets of glass substrates on top of each other with a predetermined space formed therebetween in order to seal predetermined structural components inside. The structure of a display area (display cell structure) where an image is displayed will be described hereunder by reference to one example already proposed by the present applicant.

FIG. 1 is an exemplary plan view of the display cell structure of the PDP; FIG. 2, a sectional view taken on line V1—V1 of FIG. 1; FIG. 3, a sectional view taken on line V2—V2 of FIG. 1; FIG. 4, a sectional view taken on line W1—W1 of FIG. 1; and FIG. 5, a sectional view taken on line W2—W2 of FIG. 1.

As shown in FIGS. 1 to 5, a plurality of line electrode pairs (X and Y) are arranged in parallel so as to extend in the line direction (lateral direction of FIG. 1) of a front substrate 10 on the back of the front substrate 10 as a display surface in the display area of the PDP. Each line electrode X is formed with a transparent electrode Xa such as a T-shaped transparent conductive film of ITO (Indium Tin Oxide) and a bus electrode Xb of a metal film extended in the line direction of the front substrate 10 and connected to the narrow base end portion of the transparent electrode Xa.

Like the line electrode Y, each line electrode Y is formed with a transparent electrode Ya such as a T-shaped transparent conductive film of ITO (Indium Tin Oxide) and a bus electrode Yb of a metal film extended in the line direction of the front substrate 10 and connected to the narrow base end portion of the transparent electrode Ya.

The line electrodes X and Y are arranged alternately in the column direction (vertical direction of FIG. 1) of the front substrate 10. The pair of transparent electrodes Xa and Ya arranged in a row along the bus electrodes Xb and Yb are respectively extended in the directions of the opposite line electrodes. Moreover, the broad top-side portions of the transparent electrodes Xa and Ya face each other with a predetermined discharge gap g held therebetween.

The bus electrodes Xb and Yb are formed into a two-layer structure having black conductive layers Xb1 and Yb1 on the display surface side and main conductive layers Xb2 and Yb2 on the back side. On the back of the front substrate 10, a black light-absorption layer (shield layer) 30 extending in the line direction along the bus electrodes Xb and Yb is formed between the bus electrodes Xb and Yb sitting back to back with respect to the adjoining line electrode pair (X and Y) arranged in a row direction. Further, a light absorption layer (shield layer) 31 is formed in a portion opposite to the vertical wall 35*a* of each partition wall 35.

On the back of the front substrate 10, a dielectric layer 11 is formed so as to cover the line electrode pairs (X and Y) and on the back of the dielectric layer 11, a bulked dielectric layer 11A protruding from the back of the dielectric layer 11 is formed so as to extend in parallel to the bus electrodes Xb and Yb in a position opposite to the bus electrodes Xb and Yb adjacent to the adjoining line electrode pair (X and Y) and in a position opposite to the area between the bus electrode Xb and the bus electrode Yb adjacent to each other.

A protective layer 12 of MgO is formed on the back side of the dielectric layer 11 and the bulked dielectric layers 11A. On the other hand, column electrodes D are arranged in parallel at predetermined intervals on the display-side surface of a back substrate 13 arranged in parallel to the front substrate 10 so that each column electrode D is extended in a direction perpendicularly crossing the line electrode pair (X and Y) (in the column direction) in a position opposite to the pair of transparent electrodes Xa and Ya of the line electrode pair (X and Y). On the display-side surface of the back substrate 13, further, a white dielectric layer 14 for covering the column electrodes D is formed and the partition walls 35 are formed on the dielectric layers 14.

The partition walls 35 are formed into the shape of a lattice by the vertical wall 35*a* extending in the column direction in a position between the column electrodes D arranged in parallel to each other and the horizontal wall 35*b* extending in the line direction in a position opposite to the bulked dielectric layer 11A. With the lattice like partition walls 35, the space between the front substrate 10 and the back substrate 13 is formed into sections, in each of which the transparent electrodes Xa and Ya are placed opposite to each other in the line electrode pair (X and Y) to form a discharge space S.

The display-side face of the vertical wall 35*a* of each partition wall 35 is not in contact with the protective layer 12 (see FIG. 4) and a space γ is formed therebetween. However, the display-side face of the horizontal wall 35*b* is brought into contact with a portion of the protective layer 12, the portion being used to cover the bulked dielectric layer 11A (see FIGS. 2 and 5), so that adjoining discharge spaces S in the column direction are shielded from each other.

A phosphor layer 16 is formed on the vertical walls 35*a* and the sides of the horizontal walls 35*b* of the partition walls 35 facing each discharge space S and the surface of the dielectric layer 14 in such a manner as to cover all of these five sides in due order.

The color of the dielectric layers 16 is set R, G and B in the line direction successively in the respective discharge spaces S (see FIG. 4). Moreover, rare gas is enclosed in the discharge spaces S. The horizontal walls 35*b*1 and 35*b*2 of each partition wall 35 that separates the discharge space S from another are separated from each other in the column direction by a space SL provided in a position where the light absorption layer 30 between display lines is placed above the space SL.

More specifically, the partition walls 35 are formed into the shape of a lattice along the display lines L and arranged in parallel to each other via the space SL extending along the display lines L in the column direction. The width of the space SL is set so that the width of the portions 35*b*1 and 35*b*2 of the horizontal wall 35*b* separated from each other by the space SL provided between the display lines L becomes substantially equal to the width of the vertical wall 35*a*.

In the PDP above, the line electrode pair (X and Y) forms one display line (line) L of a matrix display screen and each of the discharge spaces S separated from each other by the latticelike partition wall 35 is used to determine one subdivided discharge cell C.

The PDP above is produced by laying the front substrate formed with the line electrode pairs, the dielectric layer, the bulked dielectric layers and the protective layer upon the back substrate formed with the column electrodes, the protective layer of the column electrodes, the partition walls and the phosphor layers; by sealing the surrounding of the combination of the substrates; forming a vacuum in the interior space therebetween; and enclosing a discharge gas therein.

However, in case where the structural components formed on both the front and back substrates cause a relative deviation in position when the substrates are stuck together, a normal electric discharge is impeded and good display quality is unavailable. Consequently, positioning marks have been formed outside the display area of the PDP on the substrates whereby to carry out the positioning of both the substrates relatively.

FIG. 6 is a diagram illustrating conventional positioning-mark forming layers. In the display area of the PDP, a cross section taken on line from V1 up to W1 and perpendicularly folded at K of FIG. 1 shows the relation between each layer within the display area and the positioning-mark forming layers formed outside the display area.

As shown in FIG. 6, metal films as bus marks Mb are formed on the outer side 10*b* of the display area of the front substrate, the bus marks Mb being formed in the same layer as a layer in which the bus electrodes Xb and Yb are formed within a display area 10*a*. Further, metal films as address marks Ma are formed on the outer side 13*b* of the display area of the back substrate, the bus marks Ma being formed in the same layer as a layer in which the column electrodes D are formed.

Heretofore, the bus marks Mb and the address marks Ma have been used as positioning marks. As the bus marks Mb and the address marks Ma are formed of metal films, the relative positions of the marks are made detectable by the use of transmissive illumination, so that it is possible to carry out the positioning of the bus electrodes Xb and Yb and the column electrodes D that are formed in the respective mark-positioning layers.

With respect to influence over the performance of the PDP affected by relative deviation in position as mentioned above, importance is directed to the positional accuracy of the transparent electrodes Xa and Ya projected opposite to each other via the discharge gap on a cell basis against the partition wall (especially the vertical wall 35*a*) or the positional accuracy of the bulked dielectric layer 11A against the partition wall (especially the horizontal wall 35*b*).

The transparent electrodes Xa and Ya and the bulked dielectric layers 11A are formed on the front substrate 10 with the bus marks Mb as a reference, whereas the partition walls 35 are formed on the back substrate 13 with the address marks Ma as a reference. Therefore, deviation in position caused at the step of formation or deviation in position caused at the step of calcination under the influence of reduction in the size of the substrate tends to occur against each of the marks.

In the PDP formed by carrying out the positioning of both the substrates relatively based on the bus marks Mb and the address marks Ma and sticking the front substrate 10 and the back substrate 13 together, such deviation in position is liable to occur between the transparent electrodes Xa and Ya and the partition wall (vertical wall 35*a*) or the bulked dielectric layer 11A and the partition wall (horizontal wall 35*b*).

Further, the influence of deviation in position increases when the display cells are reduced in size so as to cope with sophistication of the PDP, the problem is that the performance of the PDP lowers.

SUMMARY OF THE INVENTION

An object of the invention made to solve the foregoing problems is to provide a display panel designed to improve accuracy in putting substrates on top of each other and to prevent performance from lowering because of deviation in position.

In order to accomplish the object, according to one aspect of the invention, there is provided a display panel including a first substrate with transparent display electrodes disposed for forming display cells within a display area, a second substrate disposed separately from and opposite to the first substrate and formed with partition walls for forming sections of the display cells within the display area, a first positioning mark disposed in at least two or more positions outside the display area of the first substrate, and a second positioning mark disposed in at least two or more positions outside the display area of the second substrate, wherein the first positioning marks and the second positioning marks are disposed so that the positional relation between the transparent electrodes and the partition walls can directly be recognized.

In addition, according to a second aspect of the invention, there is provided a display panel including a first substrate with first partition walls disposed for forming sections of transparent display electrodes for forming display cells and the display cells in an at least first direction, a second substrate disposed separately from and opposite to the first substrate with second partition walls disposed for forming sections of the display cells in the at least first direction within a display area, a first positioning mark disposed in at least two or more positions outside the display area of the first substrate, and a second positioning mark disposed in at least two or more positions outside the display area of the second substrate, wherein the first positioning marks and the second positioning marks are disposed so that the positional relation between the first partition walls and the second partition walls can directly be recognized.

In addition, according to a third aspect of the invention, there is provided a method of producing a display panel comprising the steps of putting a first substrate and a second substrate on top of each other, the first substrate being formed with transparent display electrodes disposed for forming display cells within a display area, the second substrate being formed with partition walls for forming sections of the display cells within the display area, and forming pairs of first positioning marks and second positioning marks for use in verifying the positioning of the transparent electrodes and the partition walls in at least two or more positions outside the display areas of the first substrate and the second substrate before the step of putting the substrates on top of each other.

In addition, according to a fourth aspect of the invention, there is provided a method of producing a display panel comprising the step of putting a first substrate and a second substrate on top of each other, the first substrate being formed with first partition walls disposed for forming sections of transparent display electrodes for forming display cells within the display area and the display cells in an at least first direction, the second substrate being formed with second partition walls disposed for forming sections of the display cells within the display area, and forming pairs of first positioning marks and second positioning marks for use in verifying the positioning of the first partition walls and the second partition walls in at least two positions outside the display areas of the first substrate and the second substrate before the step of putting the substrates on top of each other.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

A description will now be given of embodiments of the invention with reference to the drawings.

FIRST EMBODIMENT

A display panel according to a first embodiment of the invention is similar in structure to the PDP shown in FIGS. 1 to 5 excepting a front substrate 10 (first substrate) with transparent electrodes Xa and Ya disposed for displaying purposes, a back substrate 13 (second substrate) formed with partition walls 35 for forming display cell sections in a display area 10*a* disposed separately from and opposite to the front substrate 10, and positioning marks (first positioning marks M1 and second positioning marks M2) for use at the step of putting both the substrates on top of each other.

The structure of the positioning marks for use at the step of putting the substrates on top of each other concerning the display panel according to the first embodiment of the invention will be described hereunder by reference to FIGS. 7 to 9B.

Figure 1:
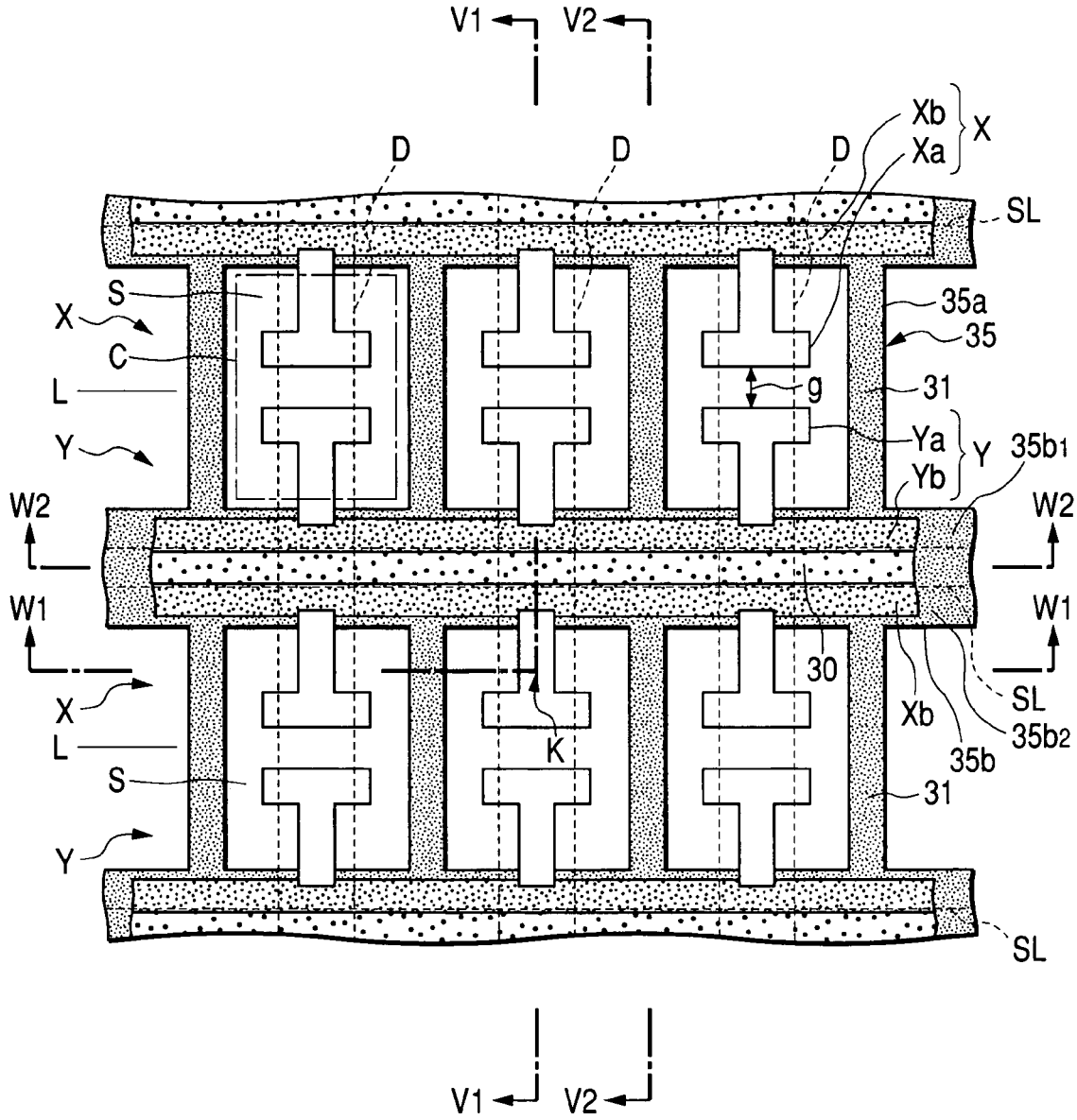
FIG. 1 is an exemplary plan view of the display cell structure of PDP.
Figure 2:
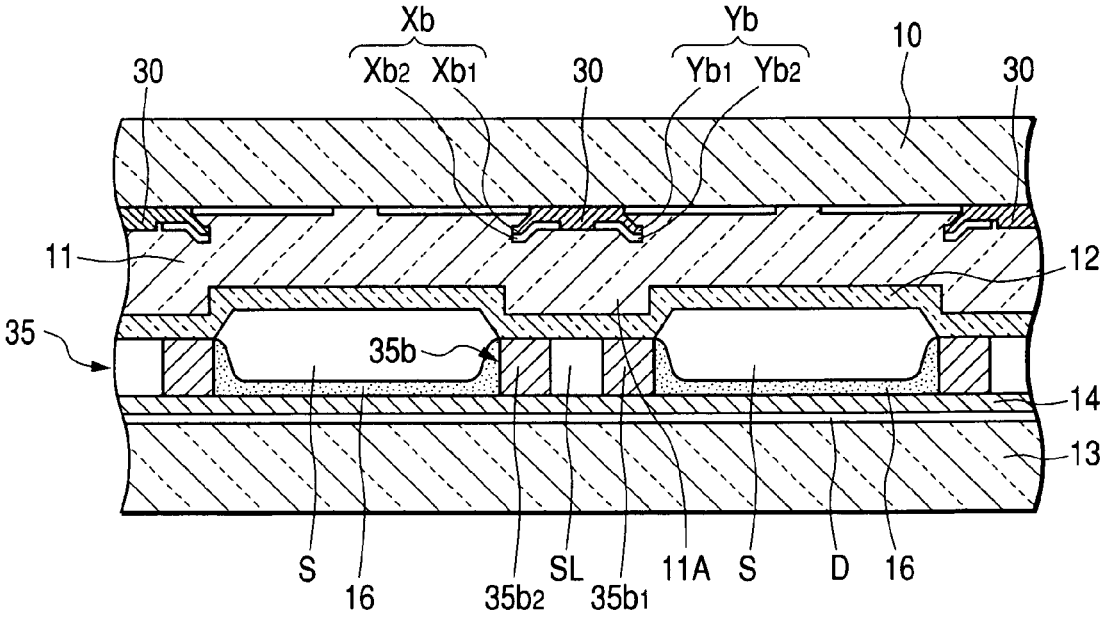
FIG. 2 is a sectional view taken on line V1—V1 of FIG. 1.
Figure 3:
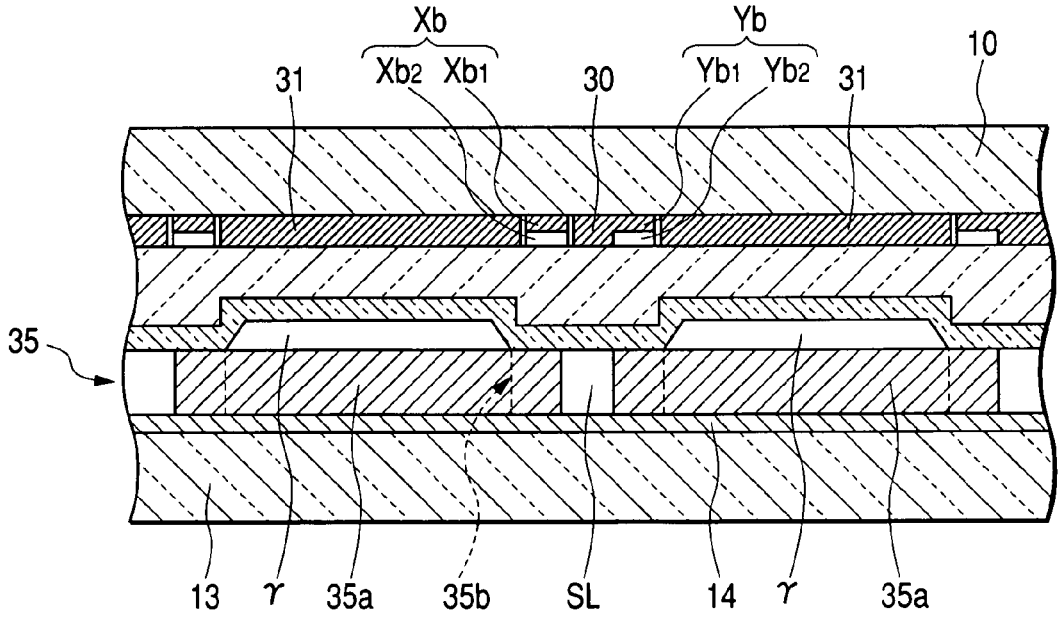
FIG. 3 is a sectional view taken on line V2—V2 of FIG. 1.
Figure 4:
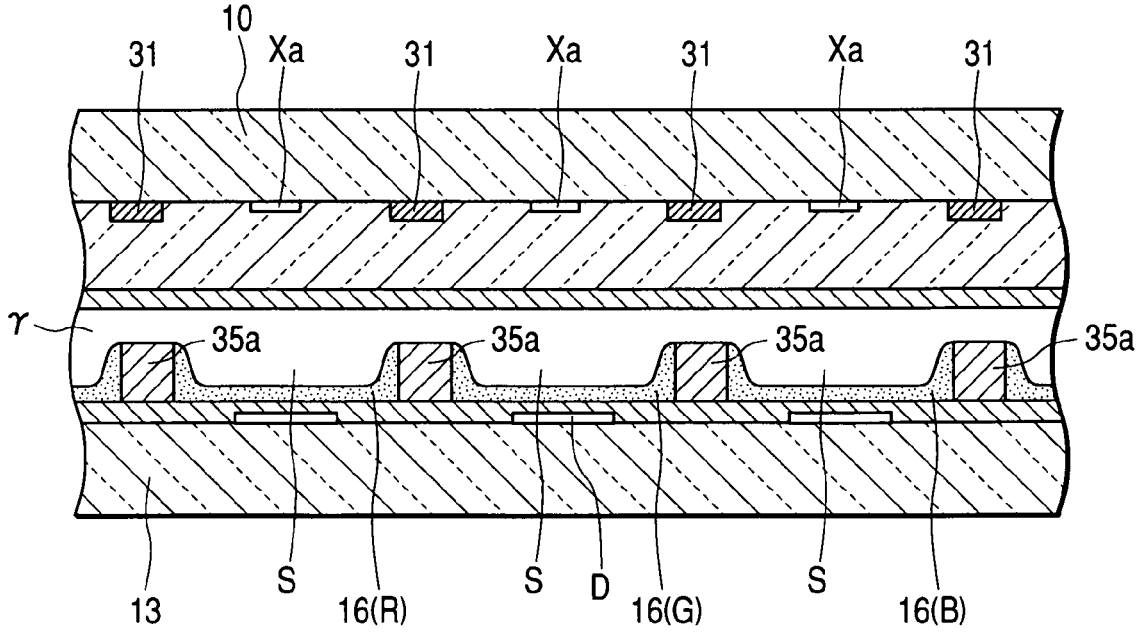
FIG. 4 is a sectional view taken on line W1—W1 of FIG. 1.
Figure 5:
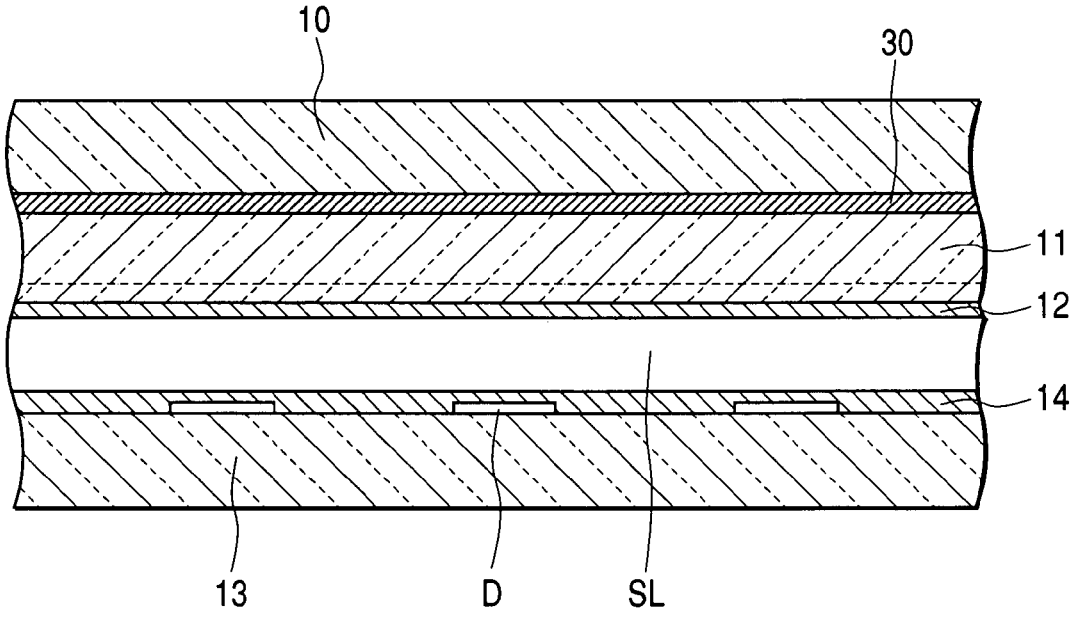
FIG. 5 is a sectional view taken on line W2—W2 of FIG. 1.
Figure 6:
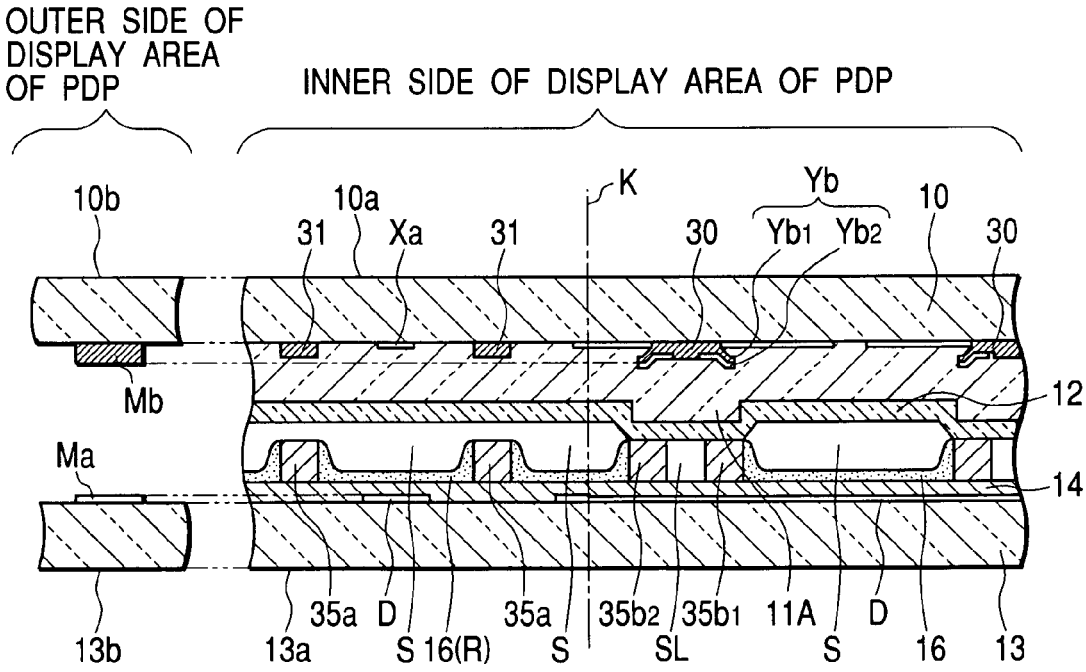
FIG. 6 PRIOR ART
FIG. 6 is a diagram illustrating conventional positioning-mark forming layers.
Figure 7:
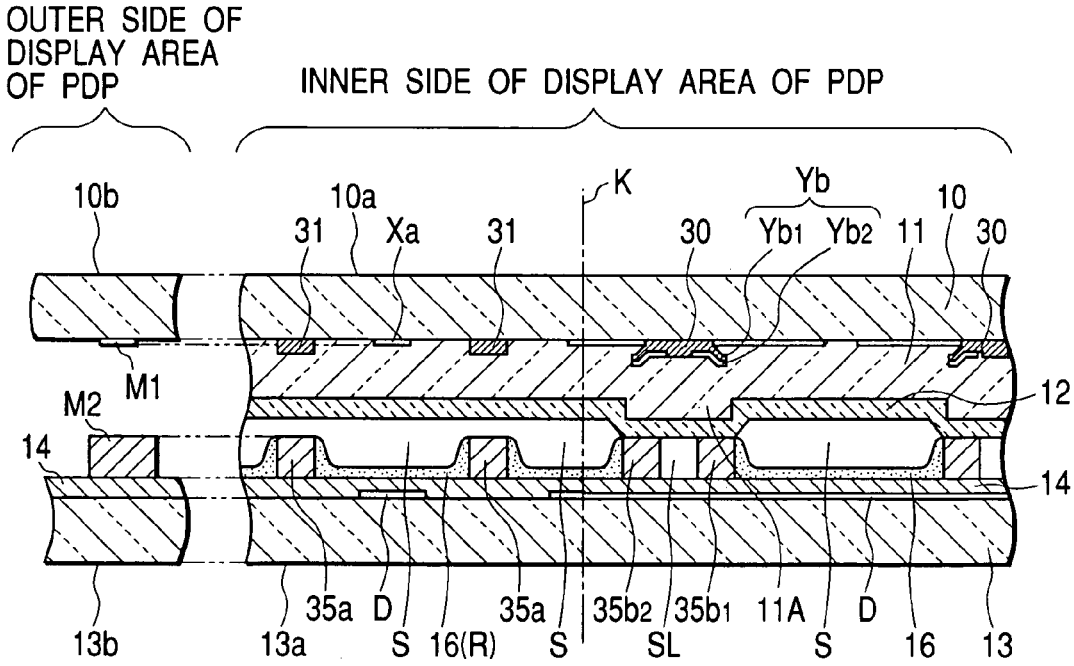
FIG. 7 is a diagram illustrating positioning-mark forming layers of a display panel according to the first embodiment of the invention.

FIG. 7 is a diagram illustrating positioning-mark forming layers of the display panel according to the first embodiment of the invention. In the display area of the PDP, a cross section taken on line from V1 up to W1 and perpendicularly folded at K of FIG. 1 shows the relation between each layer within the display area and positioning-mark forming layers formed outside the display area.

In the display panel according to the first embodiment of the invention, the first positioning marks Ml are formed on the outer side 10*b* of the display area of the front substrate and in the same layer as a layer in which the transparent display electrodes Xa and Ya are formed within the display area 10*a* as shown in FIG. 7; moreover, the second positioning marks M2 are formed on the outer side 13*b* of the display area of the back substrate and in the same layer as a layer in which the partition walls 35 are formed within the display area 10*a*.

Figure 8A:
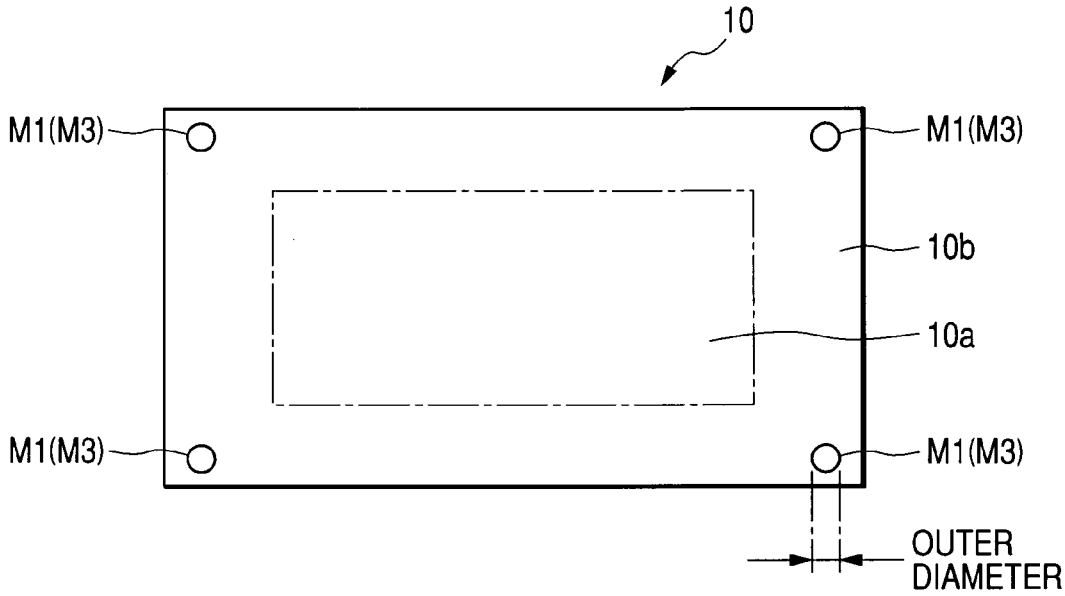
FIGS. 8A and 8B are plan views showing exemplary positions 8A where first positioning marks are formed and positions 8B where second positioning marks are formed according to first and second embodiment of the invention.
Figure 8B:
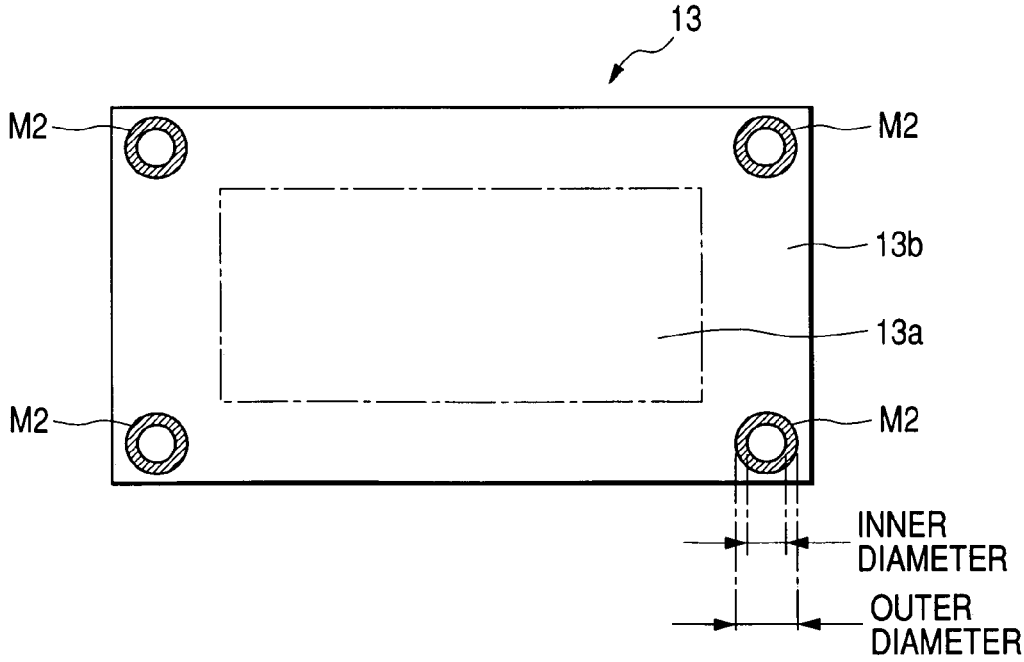

Positions where the first positioning marks and the second positioning marks are formed will now be described. FIGS. 8A and 8B are plan views illustrating the positions where the first positioning marks and the second positioning marks are formed by way of example.

As shown in FIG. 8A, a columnar ITO mark M1 (the first positioning mark) having an outer diameter of 0.5 mm, for example, is formed at four corners on the outer side 10*b* of the display area of the front substrate at the same step as that of forming the transparent electrodes Xa and Ya, the ITO marks M1 being made of the same material as the material of transparent conductive films of ITO. In this case, no dielectric layers are formed on the respective ITO marks M1.

As shown in FIG. 8B, further, a cylindrical rib mark M2 (the second positioning mark) having an outer diameter of 1.5 mm and an inner diameter of 0.8 mm, for example, is formed at four corners on the outer side 13*b* of the display area of the back substrate at the same step as that of forming the partition walls 35, the rib marks M2 being made of the same material as the material of glass layers containing white pigments.

As described above, the combination of the ITO mark M1 and the rib mark M2 placed opposite to each other has a common center of gravity or a common center as shown in FIGS. 8A and 8B, so that their configurations are prevented from overlapping each other. Moreover, the forms of the ITO mark M1 and the rib mark M2 are not limited to be circular but may be elliptical, triangular, rectangular or polygonal.

Figure 9A:
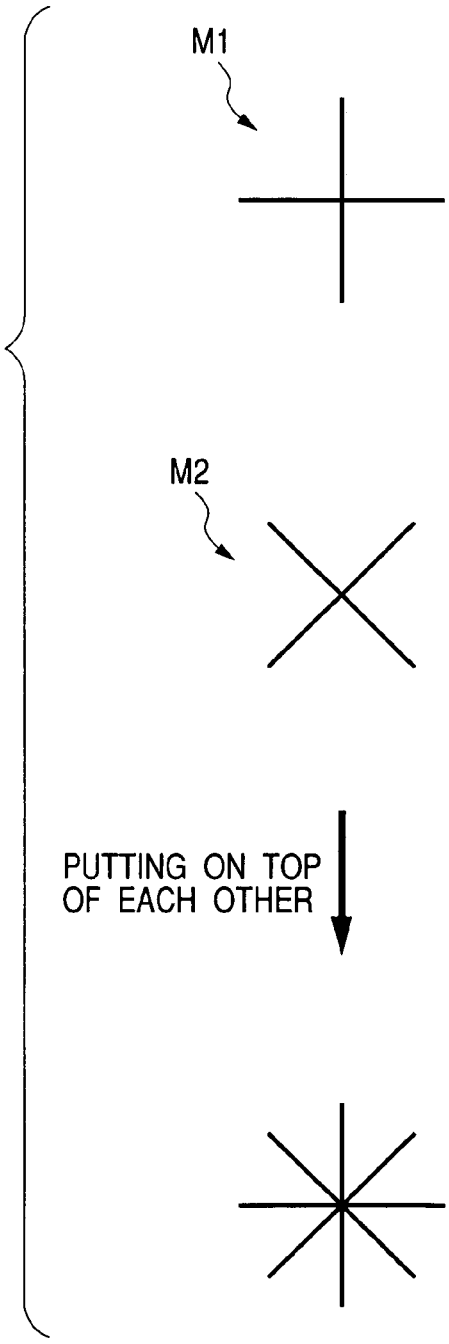
FIGS. 9A and 9B are diagrams illustrating modified examples of configurations of the positioning marks combined.
Figure 9B:
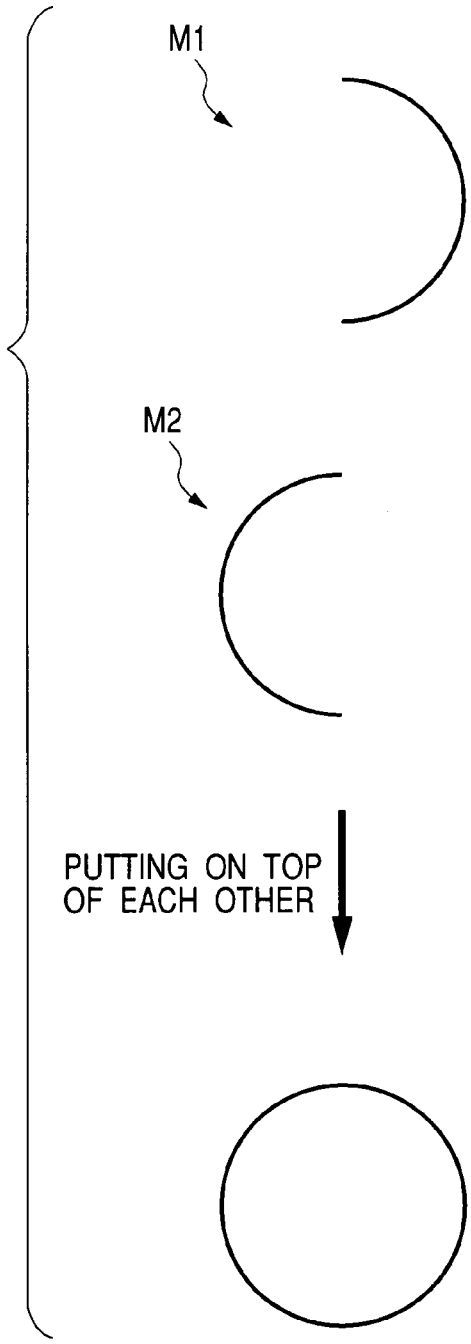

As shown in FIGS. 9A and 9B, further, whether figures combined together in a cross intersect each other at one point (see FIG. 9A) or whether arcs of semicircles combined together form a circle (see FIG. 9B) may be used to form the ITO marks M1 and the rib marks M2 so that the positional relation therebetween is made recognizable by the figures resulting from joining the combination of the opposite marks.

As described above, the display panel according to the first embodiment of the invention has the ITO mark M1 (first positioning mark) disposed in at least two or more positions on the outer side 10*b* of the display area of the front substrate and the rib mark M2 (second positioning mark) disposed in at least two or more positions on the outer side 13*b* of the display area of the back substrate.

With the ITO marks M1 (first positioning marks) and the rib marks M2 (second positioning marks) thus structured and disposed as shown in FIGS. 7, 8A and 8B above in the display panel according to the first embodiment of the invention, the positional relation between the transparent electrodes Xa and Ya and the partition walls 35 can directly be recognized.

Steps of putting the substrates on top of each other in a method of producing the display panel according to the first embodiment of the invention will now be described by reference to FIGS. 10 to 13.

Figure 10:
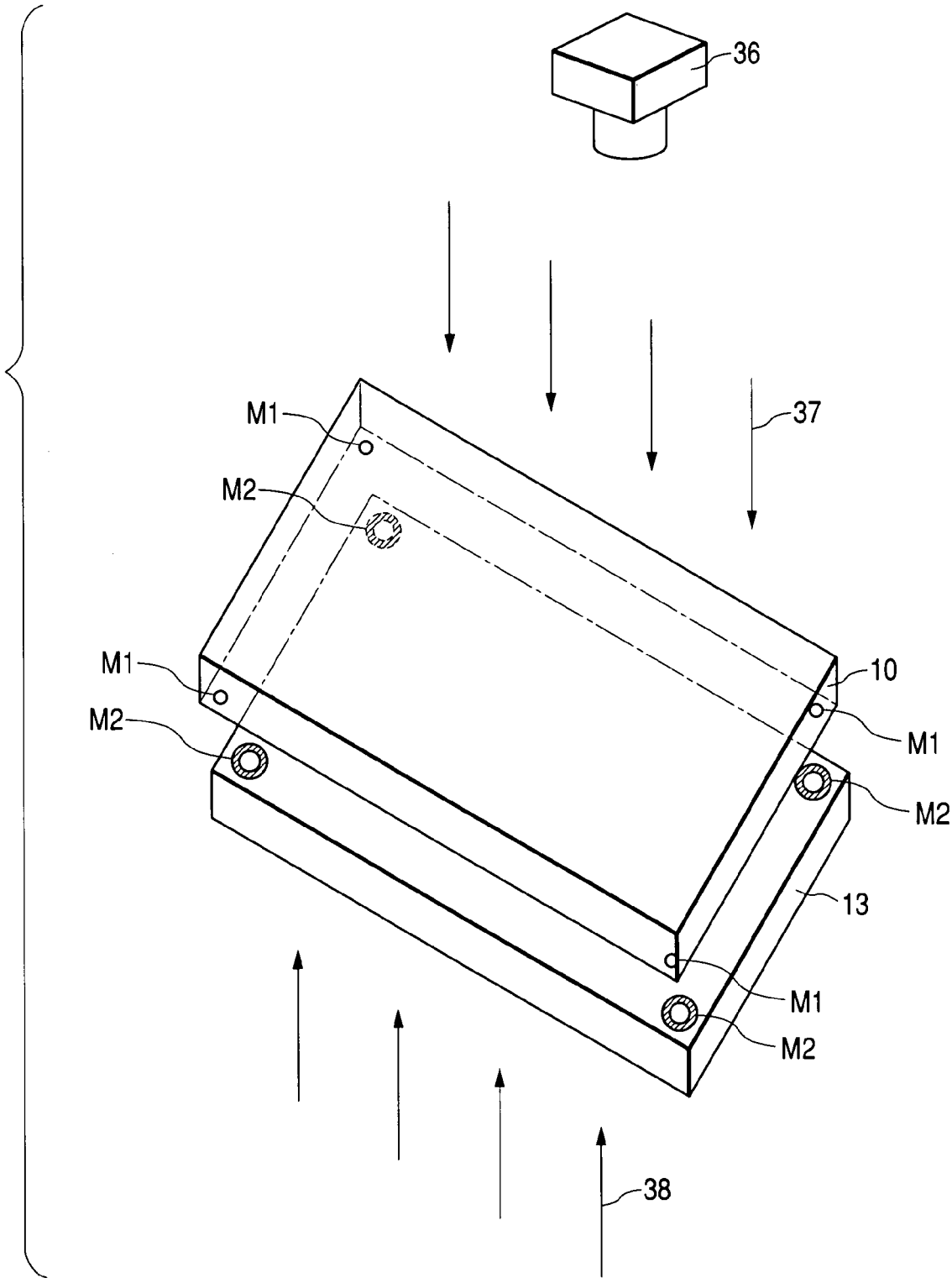
FIG. 10 is a diagram illustrating Steps S1 to S3 in putting substrates on top of each other in the method of producing display panels according to the first and second embodiments of the invention.

As shown in FIG. 10 first, the front substrate 10 with the ITO marks M1 formed thereon and the back substrate 13 with the rib marks M2 formed thereon are put on top of each other (Step S1).

Figure 11:
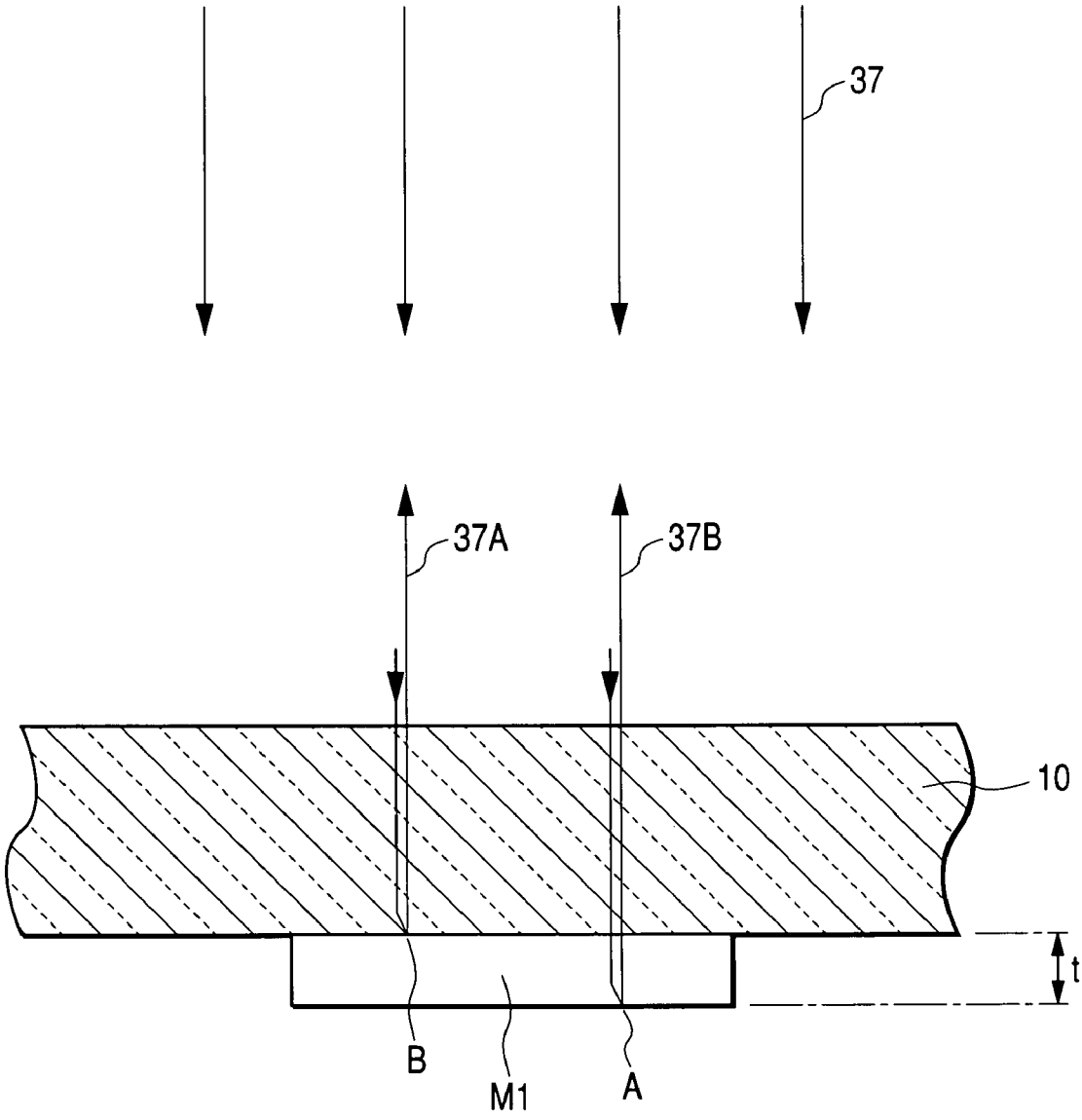
FIG. 11 is a diagram illustrating Step 2 in putting the substrates on top of each other in the method of producing the display panels according to the first and second embodiments of the invention, including an exemplary sectional view of the first positioning mark irradiated with falling illumination.

As the ITO marks M1 are transparent marks, the ITO marks are then irradiated with falling illumination, that is, monochromatic rays of light and as shown in FIG. 11, the interference of the light reflected from the face A of the ITO mark M1 in contact with the front substrate 10 with what is reflected from the opposite face B thereof are recognized and the coordinates of the ITO marks M1 are measured (Step S2).

When an ITO mark M1 having a film thickness of t and a refractive index of n is irradiated with monochromatic rays of light having a wavelength of $\lambda$ as falling illumination 37, for example, there exits reflected light including reflected light 37A and reflected light 37B. When the falling illumination 37 is given to the front substrate 10, the reflected light 37A and the reflected light 37B intensify the strength of each other when the film thickness t of the ITO mark M1 is $\lambda/2n$ and the ITO mark M1 looks bright but weaken the strength of each other when the film thickness t of the ITO mark M1 is $\lambda/4n$ and the ITO mark M1 looks dim. Thus, the position of the ITO mark is recognizable, whereby its coordinates can be measured.

Figure 12:
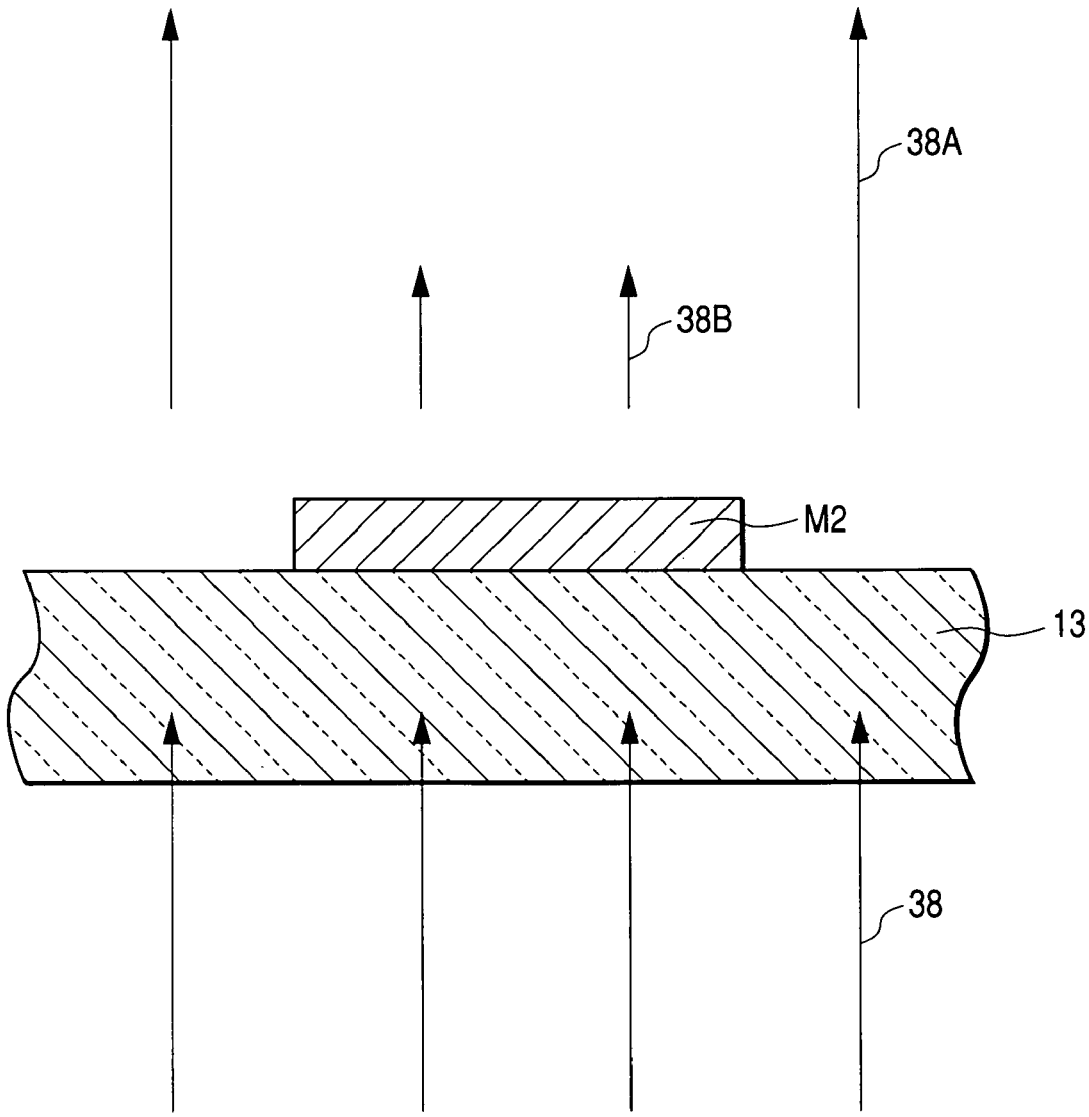
FIG. 12 is a diagram illustrating Step 3 in putting the substrates on top of each other in the method of producing the display panels according to the first and second embodiments of the invention, including an exemplary sectional view of the second positioning mark irradiated with transmissive illumination.

On the other hand, as the rib mark M2 is a mark low in transmittance, it is recognized by transmissive illumination in order to measure its coordinates (Step S3). When the rib mark M2 is irradiated with transmissible rays of light 38 from below the back substrate 13 as shown in FIG. 12, for example, transmitted light 38A through the back substrate 13 is high in transmittance and looks bright since the back substrate 13 is formed of glass. On the contrary, transmitted light 38B through the rib mark M2 is low in transmittance since the rib mark M2 is made of material low in transmittance such as a glass layer containing white pigments and a portion where the rib mark M2 exists looks darker than a portion without the rib mark M2. Thus, the position of the rib mark M2 is recognizable and this allows its coordinates to be measured.

The positions of the ITO marks M1 can be recognized by the falling illumination 37 and their coordinates can also be measured. On the other hand, the positions of the rib marks M2 can be recognized by the transmissive illumination 38 and their coordinates can also be measured. Therefore, as shown in FIG. 10, the marks can be recognized and measured by illuminating the marks from different directions.

With the failing illumination 37 and the transmissive illumination 38 given simultaneously or alternately, a monitor camera 36 is employed, for example, for detecting a contrast between light and shade regarding the transmitted light and the reflected light so as to make the mark recognition and measure the coordinates of the marks.

More specifically, the monitor camera 36 is installed on the side of the front substrate 10 and the ITO marks M1 are recognized by coaxial falling rays of light 37 from the monitor camera 36. The rib marks M2 are recognized by the transmissive illumination 38 from the side of the back substrate 13. The mark recognition is conducted by switching these different types of illumination. For example, the mode of measuring the coordinates of the positions of the marks is controlled by using the coordinates within the viewing field of the monitor camera 36. At this time, it is needed to predetermine the position of the monitor camera 36 and the positions of the substrates (the front substrate 10 and the back substrate 13) through robot teaching so that the presence of a mark within the viewing field of the monitor camera 36 is ensured. Or absolute coordinates of the position of the monitor camera 36 are determined by reducing the position of the mark within the viewing field of the monitor camera 36 to such absolute coordinates.

Incidentally, since the mark recognition is achieved by utilizing the interference of light, the use of monochromatic light is desirable for the falling illumination 37 and the transmissive illumination 38. Further, the optimum wavelength of the monochromatic light depends on the film thickness t of the ITO mark M1.

In case that the distance between the ITO mark M1 of the front substrate 10 and the rib mark M2 of the back substrate 13 exceeds the depth of focus of the monitor camera 36 (see FIG. 10), adjusting the focus of the monitor camera 36 on each mark is carried out.

The positional deviation of the coordinates of the ITO marks M1 at four corners at Step S2 from the coordinates of the rib marks M2 at four corners at Step S3 is obtained by relatively moving the front substrate 10 and the back substrate 13 whereby to optimize the positioning of the ITO marks M1 and the rib marks M2 so that the positional deviation is minimized and uniformized (Step S4).

Figure 13:
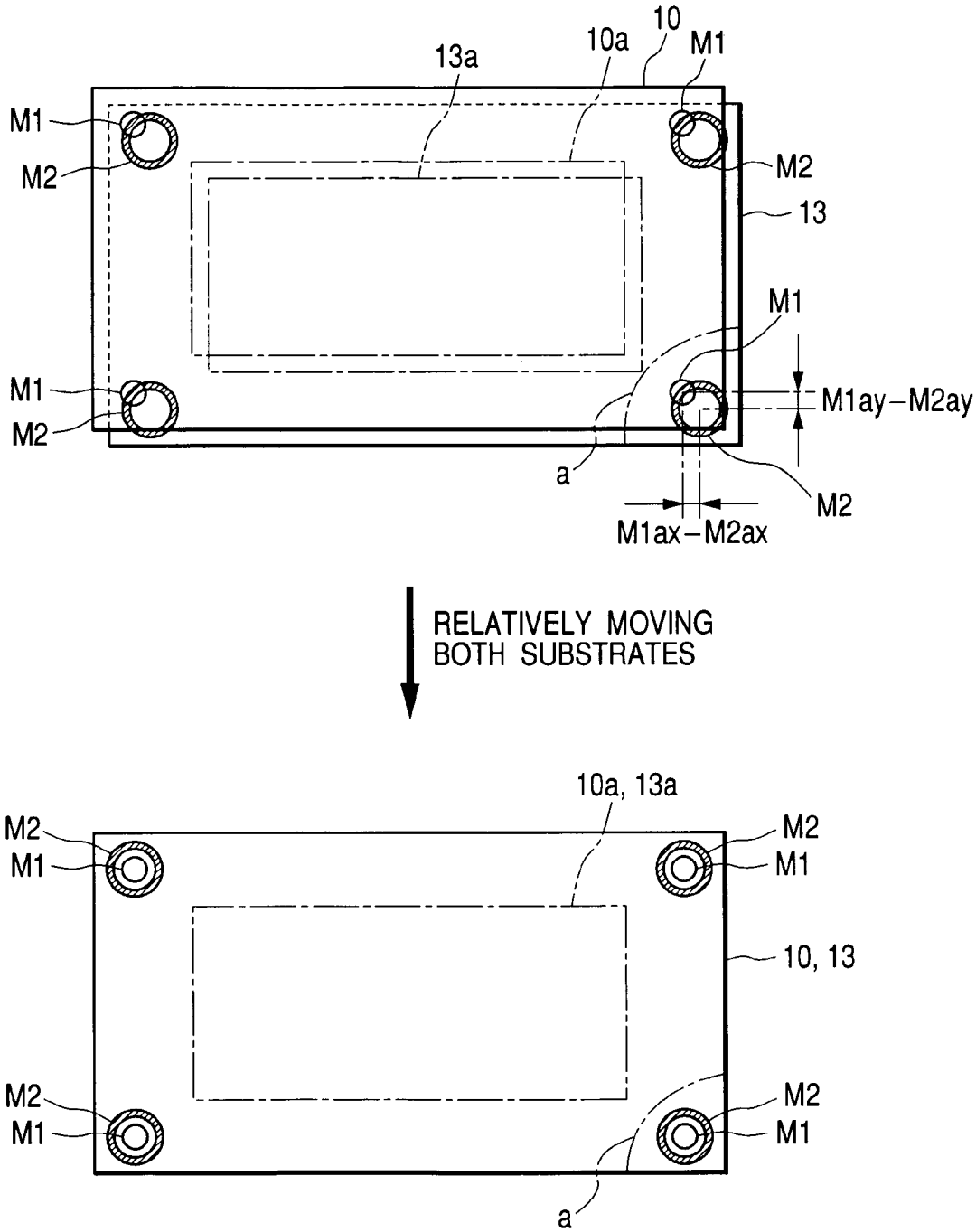
FIG. 13 is a diagram illustrating Step 4 in putting the substrates on top of each other in the method of producing the display panels according to the first and second embodiments of the invention.

As shown in FIG. 13, for example, given that the coordinates of the ITO mark M1 at any corner a are (M1*ax* and M1*ay*) and that the coordinates of the rib mark M2 thereat are (M2*ax* and M2*ay*), a deviation $\Delta$ a in position corresponding to the coordinates above is made obtainable by (M1*ax*–M2*ax* and M1*ay*–M2*ay*). Deviations in position at the rest of corners can similarly be obtained. Then the deviations in position corresponding to the respective coordinates are adjusted so as to minimize and uniformize the deviations by moving the front substrate 10 or the back substrate 13.

In case where one or two of the ITO marks M1 and the rib marks M2 at the four corners remain unrecognizable, the rest of two or three recognizable marks may be used to place the substrates on top of each other.

As described above in detail, according to the first embodiment of the invention, the transparent electrodes Xa and Ya projecting opposite to each other via the discharge gap in each cell for use in forming the display electrodes can be put upon the partition wall (vertical wall 35*a* in particular) with excellent positional accuracy when the front substrate and the back substrate are stuck together. Thus, the performance of the PDP is prevented from being affected by the positional deviations and good display quality becomes obtainable.

SECOND EMBODIMENT

A display panel according to a second embodiment of the invention is similar in structure to the PDP shown in FIGS. 1 to 5 excepting the front substrate 10 (a first substrate) with first partition walls (bulked dielectric layers 11A) disposed for forming sections of transparent display electrodes Xa and Ya as wells as display cells C in the at least first direction (the vertical direction in FIG. 1), the back substrate 13 (a second substrate) disposed separately from and opposite to the front substrate 10 with second partition walls (horizontal walls 35*b*) disposed for forming sections of the display cells C in the at least first direction within the display area 10*a*, and positioning marks (first-positioning marks and second positioning marks) for use at the step of putting the substrates on top of each other.

The structure of the positioning marks for use at the step of putting the substrates on top of each other concerning the display panel according to the second embodiment of the invention will be described hereunder by reference to FIGS. 8A, 8B and 14

Figure 14:
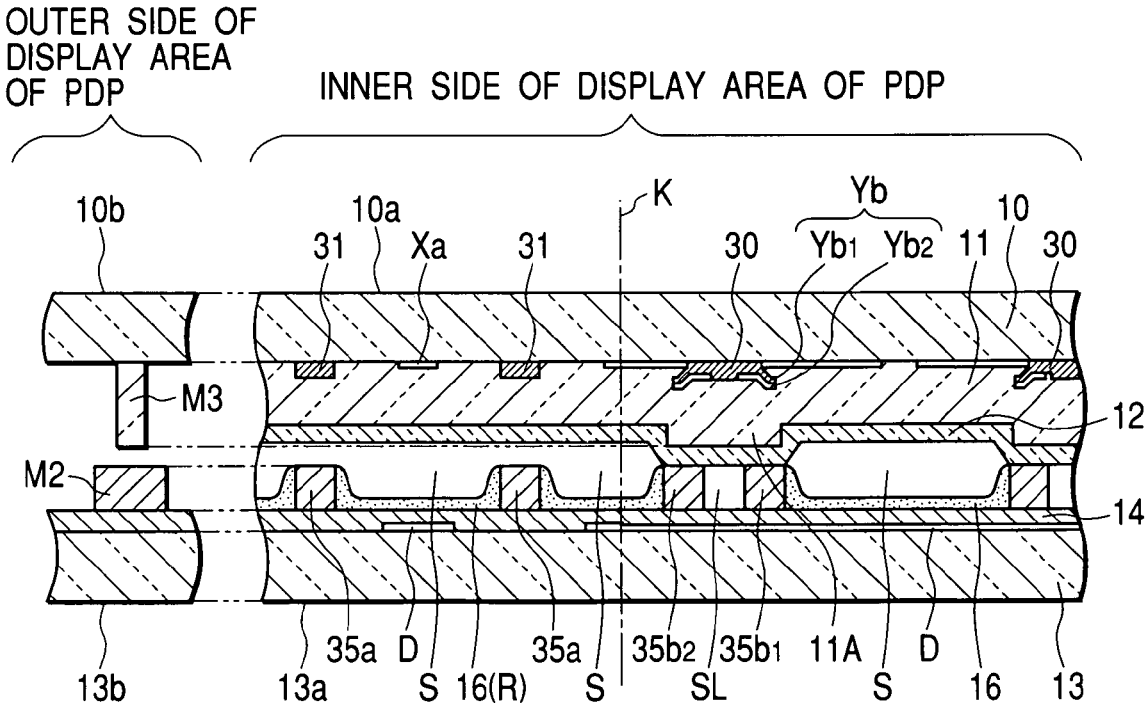
FIG. 14 is a diagram illustrating positioning-mark forming layers of a display panel according to the second embodiment of the invention.

FIG. 14 is a diagram illustrating positioning-mark forming layers of the display panel according to the second embodiment of the invention. In the display area of the PDP, a cross section taken on line from V1 up to W1 of FIG. 1 and perpendicularly folded at K shows the relation between each layer within the display area and positioning-mark forming layers formed outside the display area.

In the display panel according to the second embodiment of the invention, bulked marks M3 (first positioning marks) are formed on the outer side 10*b* of the display area of the front substrate and in the same layer as a layer (e.g., a glass layer) in which the bulked dielectric layers 11A are formed within the display area 10*a* as shown in FIG. 14; moreover, rib marks M2 (second positioning marks) are formed on the outer side 13*b* of the display area of the back substrate and in the same layer as a layer in which the horizontal walls 35*b* extending in the line direction are formed in a position opposite to the bulked dielectric layers 11A formed within the display area 13*a*.

Positions where the bulked marks M3 and the rib marks M2 are formed will now be described. The positions where the bulked marks M3 are formed are similar to those described in the first embodiment of the invention and as shown in FIG. 8A, the bulked marks M3 are provided at four corners on the outer side 10*b* of the display area of the front substrate. In this case, no dielectric layers are formed on the respective bulked marks M3.

Further, positions where the rib marks M2 are formed are similar to those described in the first embodiment of the invention and as shown in FIG. 8B, the rib marks M2 are provided at four corners on the outer side 13*b* of the display area of the back substrate.

A method of producing the display panel according to the second embodiment of the invention is similar to the method according to the first embodiment thereof and Steps S1–S4 of putting the substrates on top of each other as described above are followed with the bulked marks M3 as the first positioning marks. Then the rib marks M2 forming counterparts to the bulked marks M3 are formed on the side of the back substrate 13 and when both the substrates are put on top of each other, the bulked dielectric layers 11A (first partition walls) and the horizontal walls 35*b* (second partition walls) are properly positioned.

In this case, since the bulked marks M3 are transparent marks like the ITO marks M1, the bulked mark M3 are made recognizable by the falling illumination as in the case of the ITO marks M1.

Moreover, the ITO marks M1 and the rib marks M2 as the counterparts thereto according to the first embodiment of the invention may be formed separately when the positioning of the transparent display electrodes Xa and Ya and the partition walls 35 is carried out.

As set forth above in detail, according to the second embodiment of the invention, the bulked dielectric layers 11A (first partition walls) can be put upon the partition walls 35 (second partition walls) with excellent positional accuracy when the front substrate 10 and the back substrate 13 are stuck together. Thus, the performance of the PDP is prevented from being affected by the positional deviations and good display quality becomes obtainable.

What is claimed is:

1. A display panel comprising:

a first substrate with transparent display electrodes disposed for forming display cells within a display area;

a second substrate disposed separately from and opposite to the first substrate and formed with partition walls for forming sections of the display cells within the display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the transparent electrodes and the partition walls can directly be recognized, wherein, when the transparent electrodes and the partition walls are properly positioned, a combination of the first positioning mark and the second positioning mark forms a predetermined figure, and wherein the first positioning mark and the second positioning mark do not overlap each other when the transparent electrodes and the partition walls are properly positioned.

2. A display panel according to claim 1, wherein the first positioning mark and the second positioning mark are disposed respectively at four corner positions of the first substrate and the second substrate in a manner opposite to each other.

3. A display panel according to claim 1, wherein the first positioning mark and the second positioning mark have a common center when the transparent electrodes and the partition walls are properly positioned.

4. A display panel comprising:

a first substrate with transparent display electrodes disposed for forming display cells within a display area;

a second substrate disposed separately from and opposite to the first substrate and formed with partition walls for forming sections of the display cells within the display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the transparent electrodes and the partition walls can directly be recognized, wherein the first positioning marks are formed in the same layer as a layer in which the transparent electrodes are formed, whereas the second positioning marks are formed in the same layer as a layer in which the partition walls are formed, and wherein the first positioning mark and the second positioning mark do not overlap each other when the transparent electrodes and the partition walls are properly positioned.

5. A display panel according to claim 1, wherein the first positioning marks are formed at the same step as a step of forming the transparent electrodes, whereas the second positioning marks are formed at the same step as a step of forming the partition walls.

6. A display panel comprising:

a first substrate with transparent display electrodes disposed for forming display cells within a display area;

a second substrate disposed separately from and opposite to the first substrate and formed with partition walls for forming sections of the display cells within the display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the transparent electrodes and the partition walls can directly be recognized, wherein the first positioning marks are formed of the same material as the material of the transparent electrodes, whereas the second positioning marks are formed of the same material as the material of the partition walls, and wherein the first positioning mark and the second positioning mark do not overlap each other when the transparent electrodes and the partition walls are properly positioned.

7. A display panel comprising:

a first substrate with first partition walls disposed for forming sections of transparent display electrodes for forming display cells and the display cells in an at least first direction;

a second substrate disposed separately from and opposite to the first substrate with second partition walls disposed for forming sections of the display cells in the at least first direction within a display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the first partition walls and the second partition walls can directly be recognized, wherein, when the first partition walls and the second partition walls are properly positioned, a combination of the first positioning mark and the second positioning mark forms a predetermined figure, and wherein the first positioning mark and the second positioning mark do not overlap each other when the first partition walls and the second partition walls are properly positioned.

8. A display panel according to claim 7, wherein the first positioning mark and the second positioning mark are disposed respectively at four corner positions of the first substrate and the second substrate in a manner opposite to each other.

9. A display panel according to claim 7, wherein the first positioning mark and the second positioning mark have a common center when the first partition walls and the second partition walls are properly positioned.

10. A display panel comprising:

a first substrate with first partition walls disposed for forming sections of transparent display electrodes for forming display cells and the display cells in an at least first direction;

a second substrate disposed separately from and opposite to the first substrate with second partition walls disposed for forming sections of the display cells in the at least first direction within a display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the first partition walls and the second partition walls can directly be recognized, wherein the first positioning marks are formed in the same layer as a layer in which the first partition walls are formed, whereas the second positioning marks are formed in the same layer as a layer in which the second partition walls are formed, and wherein the first positioning mark and the second positioning mark do not overlap each other when the first partition walls and the second partition walls are properly positioned.

11. A display panel according to claim 7, wherein the first positioning marks are formed at the same step as a step of forming the first partition walls, whereas the second positioning marks are formed at the same step as a step of forming the second partition walls.

12. A display panel comprising:

a first substrate with first partition walls disposed for forming sections of transparent display electrodes for forming display cells and the display cells in an at least first direction;

a second substrate disposed separately from and opposite to the first substrate with second partition walls disposed for forming sections of the display cells in the at least first direction within a display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the first partition walls and the second partition walls can directly be recognized, wherein the first positioning marks are formed of the same material as the material of the first partition walls, whereas the second positioning marks are formed of the same material as the material of the second partition walls, and wherein the first positioning mark and the second positioning mark do not overlap each other when the first partition walls and the second partition walls are properly positioned.

13. A method of producing a display panel comprising:

putting a first substrate and a second substrate on top of each other, the first substrate being formed with transparent display electrodes disposed for forming display cells within a display area, the second substrate being formed with partition walls for forming sections of the display cells within the display area; and forming pairs of first positioning marks and second positioning marks for use in verifying the positioning of the transparent electrodes and the partition walls in at least two or more positions outside the display areas of the first substrate and the second substrate before the step of putting the substrates on top of each other, wherein proper positioning of the transparent electrodes and the partition walls is verified when combinations of the pairs of the first positioning marks and the second positioning marks form predetermined figures, and wherein the first positioning marks and the second positioning marks do not overlap each other when the transparent electrodes and the partition walls are properly positioned.

14. A method of producing a display panel according to claim 13 further comprising:

individually measuring the coordinates of the positions of the first positioning marks and the second positioning marks before the step of putting the substrates on top of each other and relatively moving the first substrate and the second substrate so that deviation in position corresponding to the coordinates thus measured is adjusted.

15. A method of producing a display panel comprising:

putting a first substrate and a second substrate on top of each other, the first substrate being formed with first partition walls disposed for forming sections of transparent display electrodes for forming display cells within the display area and the display cells in an at least first direction, the second substrate being formed with second partition walls disposed for forming sections of the display cells within the display area; and forming pairs of first positioning marks and second positioning marks for use in verifying the positioning of the first partition walls and the second partition walls in at least two positions outside the display areas of the first substrate and the second substrate before the step of putting the substrates on top of each other, wherein proper positioning of the first partition walls and the second partition walls is verified when combinations of the pairs of the first positioning marks and the second positioning marks form predetermined figures, and wherein the first positioning marks and the second positioning marks do not overlap each other when the first partition walls and the second partition walls are properly positioned.

16. A method of producing a display panel according to claim 15 further comprising:

individually measuring the coordinates of the positions of the first positioning marks and the second positioning marks before the step of putting the substrates on top of each other and relatively moving the first substrate and the second substrate so that deviation in position corresponding to the coordinates thus measured is adjusted.

17. A display panel comprising:

a first substrate with transparent display electrodes disposed for forming display cells within a display area;

a second substrate disposed separately from and opposite to the first substrate and formed with partition walls for forming sections of the display cells within the display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the transparent electrodes and the partition walls can directly be recognized, wherein the first positioning mark and the second positioning mark have a common center when the transparent electrodes and the partition walls are properly positioned, and wherein the first positioning mark and the second positioning mark do not overlap each other when the transparent electrodes and the partition walls are properly positioned.

18. A display panel comprising:

a first substrate with first partition walls disposed for forming sections of transparent display electrodes for forming display cells and the display cells in an at least first direction;

a second substrate disposed separately from and opposite to the first substrate with second partition walls disposed for forming sections of the display cells in the at least first direction within a display area;

a first positioning mark disposed in at least two or more positions outside the display area of the first substrate; and a second positioning mark disposed in at least two or more positions outside the display area of the second substrate, wherein the first positioning marks and the second positioning marks are disposed so that the positional relation between the first partition walls and the second partition walls can directly be recognized, wherein the first positioning mark and the second positioning mark have a common center when the first partition walls and the second partition walls are properly positioned, and wherein the first positioning mark and the second positioning mark do not overlap each other when the first partition walls and the second partition walls are properly positioned.

19. A display panel comprising:

a first substrate for forming display cells within a display area, wherein a first positioning mark is disposed on the first substrate, a second substrate for forming the display cells within the display area, wherein the second substrate is disposed opposite to the first substrate and wherein a second positioning mark is formed on the second substrate;

wherein, when the first substrate and the second substrate are properly positioned, a combination of the first positioning mark and the second positioning mark forms a predetermined figure, and wherein the first positioning mark and the second positioning mark do not overlap each other when the first substrate and the second substrate are properly positioned.

20. The display panel as claimed in claim 19, wherein the first positioning mark is formed outside the display area of the first substrate, and wherein the second positioning mark is formed outside the display area of the second substrate.

21. The display panel as claimed in claim 19, wherein the first substrate comprises transparent electrodes for forming display cells within the display area, and wherein the second substrate comprises partitioning walls for sectioning the display cells within the display area.

22. A display panel according to claim 19, wherein the first positioning mark and the second positioning mark have a common center when the first substrate and the second substrate are properly positioned.

23. A display panel according to claim 21, wherein the first positioning mark and the second positioning mark have a common center when the transparent electrodes and the partition walls are properly positioned.

24. A display panel according to claim 21, wherein the first positioning mark and the second positioning mark do not overlap each other when the transparent electrodes and the partition walls are properly positioned.

25. A display panel according to claim 21, wherein the first positioning mark is formed in the same layer as a layer in which the transparent electrodes are formed.

26. A display panel according to claim 21, wherein the second positioning mark is formed in the same layer as a layer in which the partition walls are formed.

27. A display panel according to claim 21, wherein the first positioning mark is formed of the same material as the material of the transparent electrodes.

28. A display panel according to claim 21, wherein the second positioning mark is formed of the same material as the material of the partition walls.

29. The display panel as claimed in claim 19, wherein the first substrate comprises first partition walls for sectioning transparent display electrodes for forming display cells within the display area, and wherein the second substrate comprises second partitioning walls for sectioning the display cells within the display area.

30. A display panel according to claim 29, wherein the first positioning mark and the second positioning mark have a common center when the first partition walls and the second partition walls are properly positioned.

31. A display panel according to claim 29, wherein the first positioning mark and the second positioning mark do not overlap each other when the first partition walls and the second partition walls are properly positioned.

32. A display panel according to claim 29, wherein the first positioning mark is formed in the same layer as a layer in which the first partition walls are formed.

33. A display panel according to claim 29, wherein the second positioning mark is formed in the same layer as a layer in which the second partition walls are formed.

34. A display panel according to claim 29, wherein the first positioning mark is formed of the same material as the material of the first partition walls.

35. A display panel according to claim 29, wherein the second positioning mark is formed of the same material of the second partition walls.

* * * * *